United States Patent [19]

Crear, III et al.

[11] Patent Number: 4,619,216

[45] Date of Patent: Oct. 28, 1986

[54] SAILBOAT LUFF SYSTEM

[76] Inventors: William Crear, III, 56 Westwood Dr., Long Lake, Minn. 55356; Roy E. Ahern, 6449 Barrie Rd., Minneapolis, Minn. 55435

[21] Appl. No.: 657,931

[22] Filed: Oct. 5, 1984

[51] Int. Cl.[4] ..... B63H 9/04

[52] U.S. Cl. ..... 114/105; 114/108

[58] Field of Search ..... 114/102-109, 114/111-115, 39; 403/345, 359

[56] References Cited

U.S. PATENT DOCUMENTS

| | | | |
|---|---|---|---|
| 3,658,025 | 4/1972 | Hood | 114/105 |
| 3,759,210 | 9/1973 | Davis | 114/105 |
| 3,802,373 | 4/1974 | Lagerquist | 114/105 |
| 3,851,608 | 12/1974 | Stern | 114/105 |
| 3,851,609 | 12/1974 | Stern | 114/105 |
| 3,927,633 | 12/1975 | Bernard | 114/105 |
| 3,948,200 | 4/1976 | Hood | 114/105 |
| 4,340,005 | 7/1982 | Lagerquist | 114/105 |

*Primary Examiner*—Trygve M. Blix
*Assistant Examiner*—C. T. Bartz
*Attorney, Agent, or Firm*—Kinney & Lange

[57] ABSTRACT

Sailboat luff system including a longitudinal one-piece extruded luff member, a feeder secured about the luff member, a spacer, and a prefeeder all positioned from top to bottom along a forestay or a headstay of a sailboat. The longitudinal extruded luff member includes two channels or grooves encompassing a third channel or groove, the two channels wrapping around to form the third channel where the third channel is supported by the forestay or the headstay of the sailboat. The extruded luff member is of a material to maintain memory of the channels with respect to each other and snaps around the forestay or headstay with a flick of the fingers. The feeder includes slots leading to the tapered holes or grooves, beveled edges and a headstay groove for securing the feeder about the luff member and feeds the sail tape through slots and grooves, respectively, towards the extruded luff member. The spacer supports a prefeeder positioned below the feeder, the prefeeder including silicon bronze rollers on a geometrical V-shaped eared member.

21 Claims, 7 Drawing Figures

Fig. 5
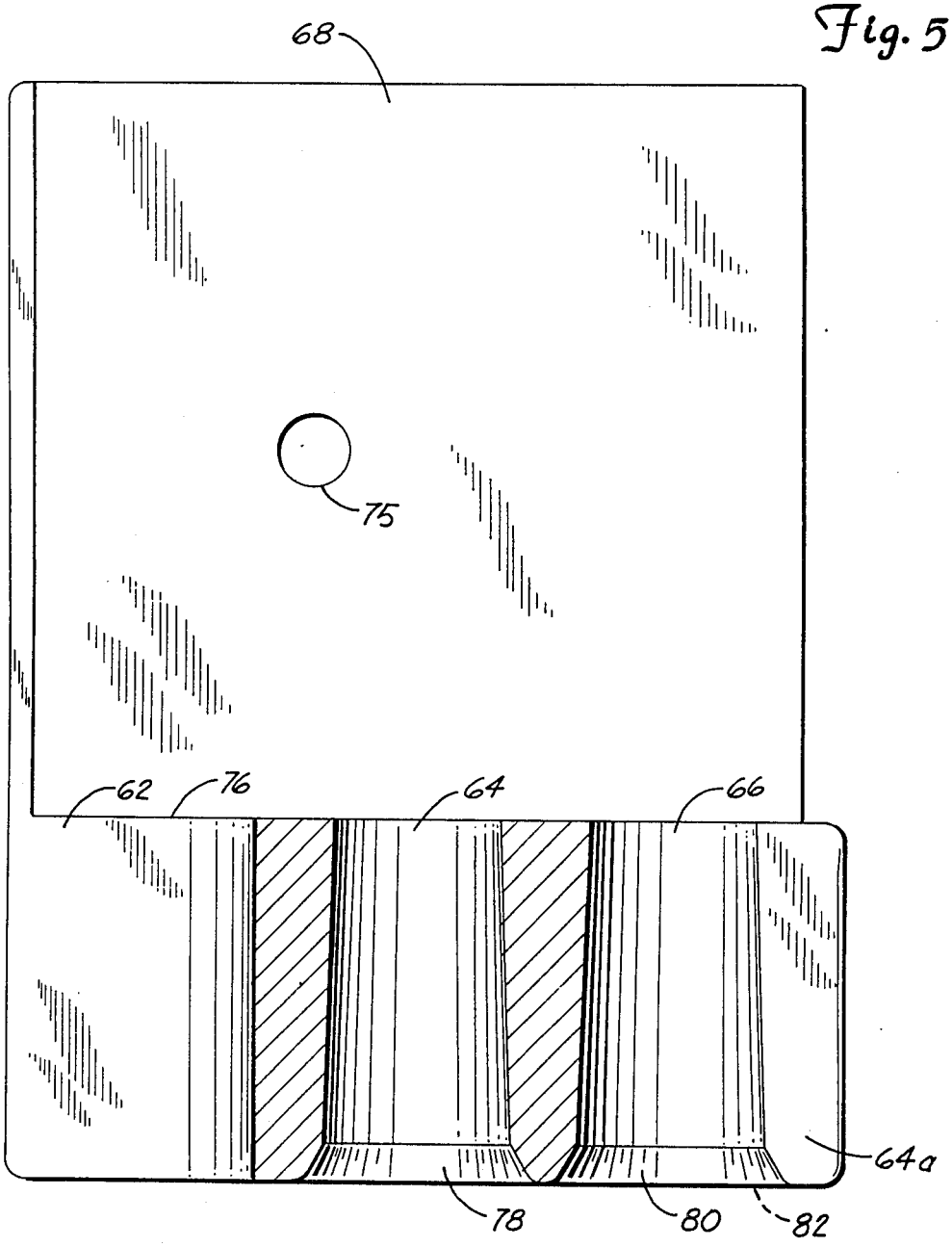
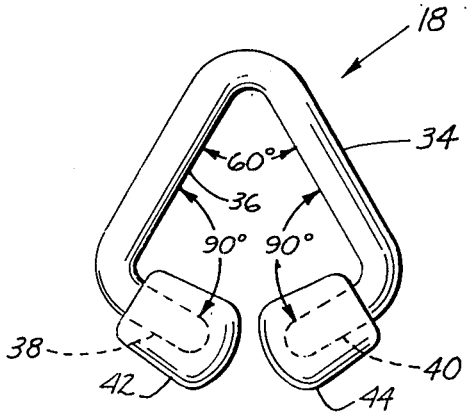
Fig. 6

SAILBOAT LUFF SYSTEM

BACKGROUND OF THE INVENTION

1. Field of the Invention

The present invention pertains to sailboats and, more particularly, pertains to a sailboat luff system including a longitudinal one-piece extruded luff member for snapping onto the forestay or headstay and for receiving the beaded leading edge of jibs fore and aft with respect to the forestay or headstay of the sailboat. A combination of the extruded luff member, the feeder and the prefeeder provides a high-tech system for feeding and supporting sails, especially jibs, about the forestay-headstay.

2. Description of the Prior Art

Representative patents of the prior art include the Lagerquist U.S. Pat. Nos. 3,802,373 and 4,340,005. These prior art devices would fasten around the headstay or forestay of a sailboat and would tend to come loose, based on either mechanical breakdown such as general wear and tear or based on the high torque involved during sailing. The locking grooves of the Lagerquist patents did not always function well after usage during an extreme amount of torque and/or tension during sailing, especially at high winds.

Stearn in U.S. Pat. Nos. 3,851,608 and 3,851,609 discloses a stream-stay and a two-groove headstay respectively. Particularly, U.S. Pat. No. 3,851,609 of Stearn discloses a structure which still depends on a mechanical means for securing the double-groove headstay onto the forestay-headstay. This provided a mechanical securing system which was subject to mechanical breakdowns as described above.

One of the problems with the prior art headstays is that the headstays were very expensive and were usually shipped in continuous lengths which had to be joined together at the boat yard, especially for the larger sailing vessels. Joining together of the headstays was not only expensive but left a mechanical joint which was subject to fatigue and breakdown, as well as wear and tear on the sail. Further, the shipping costs were prohibitive in that boxes of twenty feet or so in length had to be shipped by common motor freight carrier or the like and this was particularly expensive for an item which hardly weighed any physical weight but which consumed a large amount of volume when shipped in a carton or box.

Headstays were originally designed in Sweden and fashioned of wood. Prior art headstays carried a single luff bread or a luff rope in the forward edge of the jib. Later, prior art advanced to using two wire forestays where the jibs were fixed by clips known as hanks. Then, the prior art advanced to extruded aluminum systems, although this was very expensive. The art was then advanced by the Stearn patents and the Lagerquist patents.

The present invention overcomes the disadvantages of the prior art by providing a sailboat luff system including a one-piece flexible PVC plastic longitudinal extruded luff member, feeder secured thereto, and a prefeeder secured to a spacer below the feeder for jib sails. The extruded luff member can be rolled in approximately a one-yard to one-meter diameter, is easily worked with and snaps on to the headstay-forestay extremely easily with a flick of the fingers.

SUMMARY OF THE INVENTION

The general purpose of the present invention is a luff system including a longitudinal one-piece extruded luff member with three channels, one channel for the headstay or forestay and the other two channels for the aft and forward jib, a feeder of stainless steel which includes a screw bolted through the bottom of the luff member, a spacer below the feeder and a prefeeder with silicon bronze rollers positioned at the extremities of a V-shaped eared member for feeding the sail tape towards the feeder. One key point is a longitudinal one-piece extruded luff member which is flexible, can be coiled for shipment, can be installed basically with a flick of the fingers by flicking the member around and about the stay, and which springs back to a predetermined position about the forestay or headstay providing for no mechanical connections or interlocking connections as in the prior art devices.

The extruded luff member can be made of PVC plastic, Lexan, or other like polymers which are not affected by ultraviolet radiation, and has a long life on the sailboat as compared to the prior art devices.

One embodiment of the present invention includes a longitudinal extruded luff member having two channels or grooves encompassing a third channel, the third channel being supported by a forestay and headstay. Slots extend out of each groove at angles with respect to each other. The extruded luff member is a wrap-around, snap-on, one-piece, horizontal and vertical member, and can be flicked on to the headstay-forestay. A feeder mounting below the longitudinal extruded luff member includes tapered holes with beveled edges and a headstay slot along with positioned forward luff groove and slot and aft luff grove and slot. A sail tape slides up through holes, slots and grooves of the feeder into the channels or grooves of the extruded luff member. The feeder itself slides on and up, and interlocks with the channels of the extruded luff member and is fastened with a screw. A prefeeder positioned on a spacer below the feeder includes a V-shaped eared members with silicon bronze rollers for securing about the sail tape roped edge.

One significant aspect and feature of the present invention is an extruded longitudinal member which can be easily installed, shipped in a cardboard box when wound into a diameter of 36–39 inches, is flicked into position by one's fingers about the around the headstay or forestay, and which is a single, integral, one-piece extruded member. The luff member requires no fancy tools to install, otherwise than possibly a screwdriver or pliers for fastening the feeder about the bottom, can be easily worked with one's hands and sized to the very proper length, and which is inexpensive compared to the prior art devices.

Another significant aspect and feature of the present invention is an extruded luff member which can be extruded of either PVC, Lexan, or other like high-tech material which is impervious to ultraviolet radiation. This means that after being installed on a sailboat, the device will not break down when exposed to the sunlight.

A further significant aspect and feature of the present invention is an extruded luff member which is reasonable in cost. Everyone knows that components for boats, especially sailboats, are expensive, but this invention is to the contrary, being of a reasonable cost compared to any of the prior art models currently being sold by sailboat manufacturers, vendors, factories, shops, etc.

An additional significant aspect and feature of the present invention is a sailboat luff system which includes integrally a longitudinal extruded one-piece luff member, a feeder, a spacer, and a prefeeder all cooperating to feed a bead edged sail tape through the prefeeder, up through the feeder and into one of the two channels or grooves and slots of the luff member.

Having thus described embodiments of the present invention, it is a principal object hereof to provide an extruded luff member.

One object of the present invention is an entire luff system including the extruded luff member where the member is only one integral continuous piece. This provides for ease of assembly, as well as ease of operation. There are no joints in the extruded luff, but only a continuous extruded member.

A further object of the present invention is an extruded luff member including a stainless steel feeder which requires no fancy tools to install, but only a screwdriver, possibly a tapeline for measuring the length of the forestay or headstay prior to assembly, a coping saw to saw and adjust finite length for the extruded member, and a pair of human fingers to separate the channels and flick the extruded luff member onto the forestay-headstay.

BRIEF DESCRIPTION OF THE DRAWINGS

FIG. 5 illustrates a section view of the feeder taken along line 5—5 of FIG. 4;

FIG. 6 illustrates a plan view of the prefeeder, and;

DESCRIPTION OF THE PREFERRED EMBODIMENTS

Figure 1:
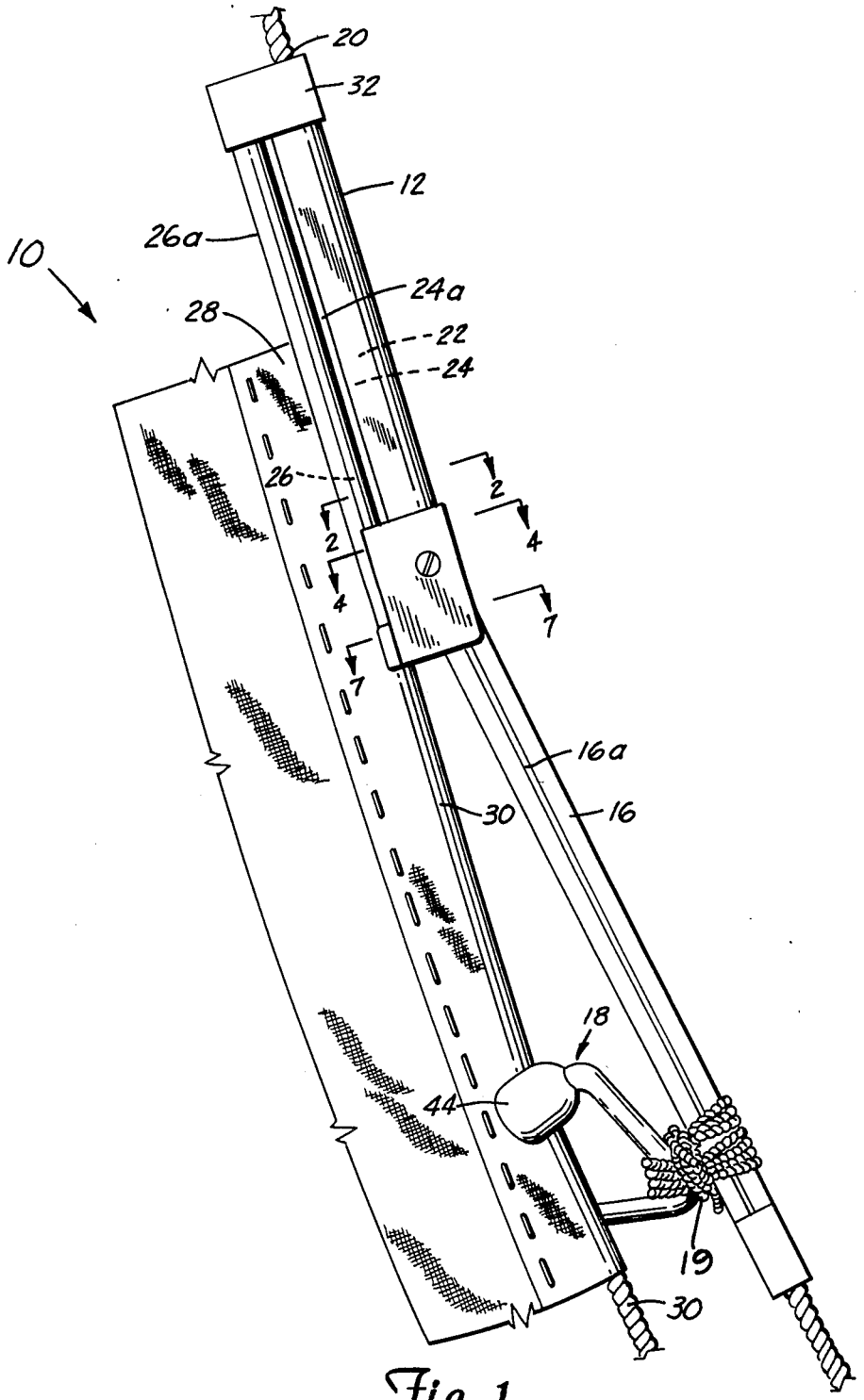
FIG. 1 illustrates a side view of a sailboat luff system, the present invention, showing the longitudinal extruded luff member, the feeder, the spacer, and the prefeeder from top to bottom.
Figure 2:
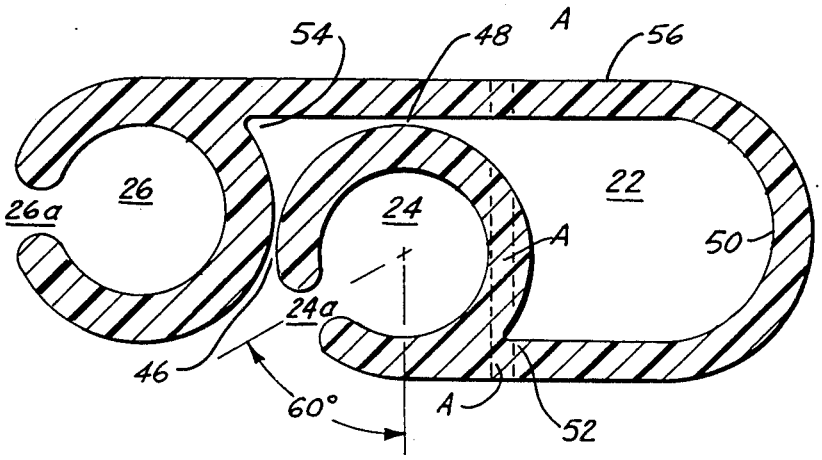
FIG. 2 illustrates a section view of the extruded luff member taken along line 2—2 of FIG. 1.
Figure 7:
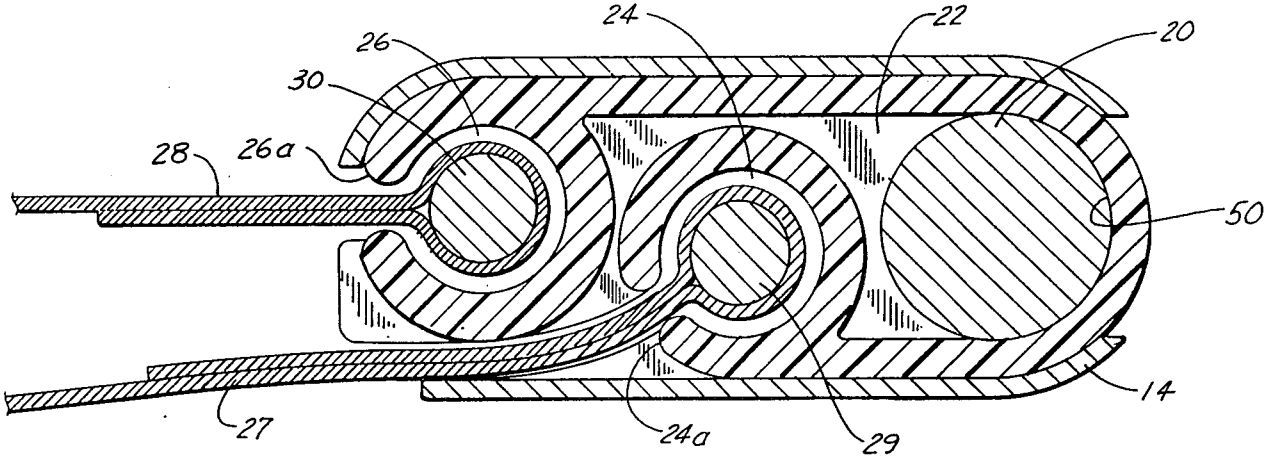
FIG. 7 illustrates a section view of the longitudinal extruded luff member and the feeder taken along line 7—7 of FIG. 1.

FIG. 1 illustrates a plan view of a sailboat luff system 10, the present invention, including a longitudinal one-piece continuous extruding luff member 12, a feeder 14, a spacer 16, and a prefeeder 18 about a headstay or forestay 20 of a sailboat. The longitudinal extruder member 12 includes a first channel or groove 22, as illustrated in FIG. 2, a second channel or groove 24 and a third channel or groove 26 as also illustrated in FIG. 2, with respect to each other in a maintained memory relationship based on inherent qualities of the material. A sail tape 28 with a rope bead 30 sewn and glued therein extends up through the aft luff groove 26 and a connecting slot 26*a* therein also illustrated in FIG. 2 in this example. Likewise, the forward luff groove 24 accommodates like sail tape 27 and rope bead 30 through connection slot 24*a* as shown in FIG. 7. Chafing tape 32 extends around the top of the extruded luff member 12 such as at the top of a mast. Feeder 14 secures by sliding and interlocking on and up into the bottom of the extruded luff member 12, as later described in FIGS. 4 and 5. The spacer 16 includes a longitudinal slit 16*a* for slipping on and snapping about the stay 20. As shown in FIG. 6, the prefeeder 18 includes two legs 34 and 36, two ears 38 and 40, and two silicon bronze balls or rollers 42 and 44 mounted on the ears 38 and 40. An angle of approximately 60° is at the apex of the two legs and an angle of 90° between each of the ears and the legs, as illustrated in FIG. 6.

The prefeeder 18 is supported on the spacer 16 and thus forestay 20 with a line indicated at 19, at a position spaced below the feeder 14. The sail tape fits between the rollers 42 and 44. The rope bead 30 is within the opening defined by the legs 34 and 36. Note in FIG. 6 that the opening between the rollers 42 and 44 is narrow. The prefeeder permits the rope bead of the sail tape to be held and guided at a small angle with respect to the feeder 14 and luff member 12 to aid in guiding the sail tape into the feeder and into the luff grooves of the luff member.

Figure 3:
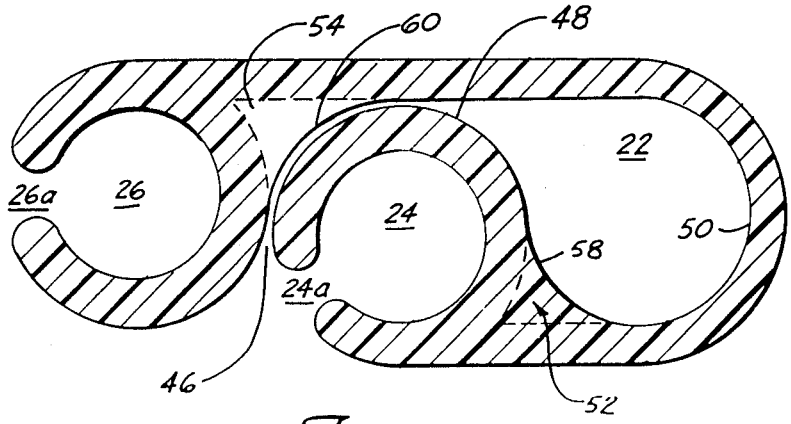
FIG. 3 illustrates an alternative embodiment of FIG. 2.

FIG. 2 illustrates a section view taken along line 2—2 of FIG. 1 where all numerals correspond to those elements previously described. A space 46 is illustrated where the forward luff groove 24 is substantially adjacent the aft luff groove 26. Point 48 is where a portion of the forward luff groove 24 may come in contact with the longest planar portion of the forestay channel, groove, or hole 22. The angle of the exit of the forward luff slot 24*a*, with respect to the perpendicular of the longest planar side of the forestay hole 22, is approximately 60°, by way of example and for purposes of illustration only and not to be construed as limiting of the present invention. The radius 50 of the forestay hole is appropriately sized to the radius of the forestay. Indentations 52 and 54 are provided for molding purposes, but can be eliminated as illustrated in FIG. 3 as an alternative embodiment of the luff member 12. The radius of each of these forward luff slots and aft luff slots 24 and 26, respectively, are substantially determined by the diameter of the bead of the sail tape. The width of each of the slots 24*a* and 26*a* is likewise determined by the width of two layers of the sail luff for sliding through each of the slots 24*a* and 26*a*, respectively. The overall thickness of the member 12 of each of the cross sections is determined by the size of the diameters of the forestay hole, as well as the luff grooves, and other mechanical considerations. The material of member 12 can either by PVC such as B. F Goodrich GEON® 85857 which is a polyvinylchloride PVC material, Lexan®, Teflon PFA, or any other suitable material, by way of example and for purposes of illustration only and not to be construed as limiting of the present invention. Any high tensile strength polymer impervious to ultraviolet radiation would be appropriate. While the geometrical cross section is an elongated oval, other cross sections could be used with the wray-around three-channel configuration.

FIG. 3 illustrates an alternative embodiment of FIG. 2 where the fillets 52 and 54 are illustrated in dashed lines. In this alternative embodiment, the fillets have been filled in with round areas 58 and 60 of extruded material. Otherwise, the structure is identical to that of FIG. 2.

Figure 4:
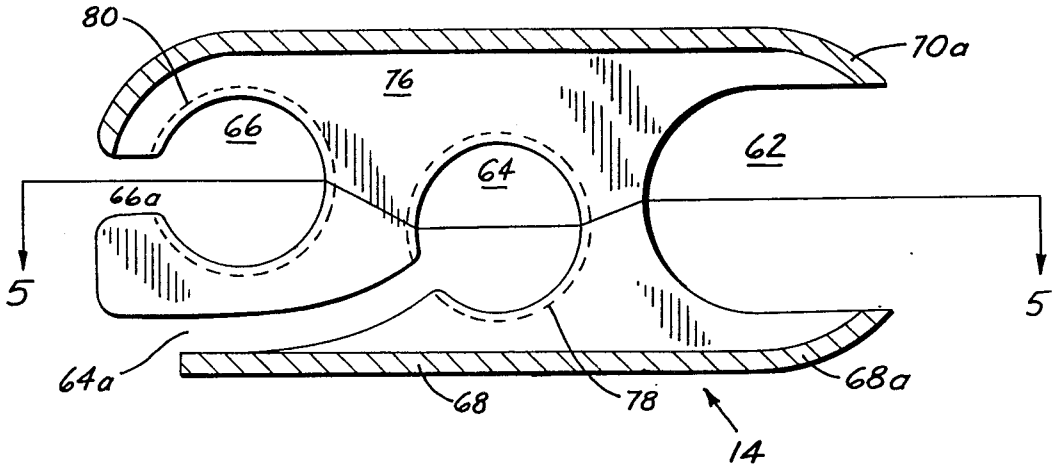
FIG. 4 illustrates a section view of the feeder taken along line 4—4 of FIG. 1.

FIG. 4 illustrates a sectional view of feeder 14 taken along line 4—4 of FIG. 1 where the feeder includes a forestay slot 62, a forward luff groove 64 and an aft luff groove 66, the forward luff groove including a forward luff slot 64*a* and the aft luff groove including an aft luff slot 66*a*. It is noted that the forward luff slot 64*a* has a considerably longer cross-sectional length with respect to the aft slot 66*a* length for purposes of feeding sail tape. The grooves 64 and 66 are tapered downwardly in an increasing diameter toward the bottom with beveled edges 78 and 80 as illustrated in FIG. 5 for ease of feeding the sail tape. The feeder includes a starboard side 68 and a port side 70 configured accordingly. A screw 72 secured into a threaded hole 74 for securing the feeder 14 through a hole in the luff member 12 at points A. The sides 68 and 70 encompass about and around the bottom of the luff member and interlock about thereto while the top of the cross-section 76 mates against the bottom of the luff member 12. The sides 68 and 70 extend upwardly above the top of section 76 and the vertical encompassing forward edges 68*a* and 70*a* around for capturing for support of the sides of the forestay or headstay. The width of the feeder at the forestay hole 62 is equal to or slightly larger than the diameter of the forestay. The feeder 14 slides up, over and engages in interlocking relationship with the luff member 12. The feeder 14 can also be made of stainless steel, PVC, Teflon PFA, or other like material.

FIG. 5 illustrates a sectional view of the feeder taken along line 5—5 of FIG. 4 where all numerals correspond to those elements previously described. Particularly illustrated are the tapered portions 78 and 80. Tapering 82 is also provided in the longitudinal slot 64*a*.

FIG. 6 illustrates a plan view of the prefeeder 18 where all numerals correspond to those elements previously described.

FIG. 7 illustrates a cross-section view taken along line 7—7 of FIG. 1 of the luff member and feeder where all numerals correspond to those elements previously described. Particularly shown are said tapes 28 and 27, rope bead 30 and 29 engaged in luff grooves 26 and 24, respectively. Also shown is the stay 20 engaged within radius 50 of groove 22.

MODE OF OPERATION

A sail is attached to a sailboat at three points, the head at the top, the tack, the forward lower corner, and the clew at the aft lower corner. A beaded forward edge, the head of the jib, carrying the luff tape, is fed into the bottom of one of the two slots and grooves of the luff member 12, but of course, through the prefeeder 18, the feeder 14 and into the luff member 12, as illustrated in FIG. 1. The prefeeder 18 guides the sail tape into the feeder 14 and luff member 12. A halyard raises the jib and pulls the luff tape carrying the jib sail up through the luff member. If one desires to change sails while going up wind, another jib using a second halyard can be raised up through the luff member and trimmed correctly. The original jib can be dropped accordingly. The luff member 12 allows for two jibs to be raised or lowered or two jibs to be used at the same time such as when sailing wing and wing.

The luff member 12 is measured, trimmed to length such as by a coping saw, if required, and flicked onto the stay. Pliers or a screwdriver may be required to separate the channels from the predetermined memory of FIG. 2 for subsequent flicking around the stay. Once started, the luff member snaps onto the stay in a upward or downward movement in a force over the stay and returning to the predetermined memory portion in cross-section of FIG. 2. The slots are at an angle in the range of 10° to 80°, preferably about 20°. The material of the luff member will include an ultraviolet impervious chemical. The feeder 14 can be made of stainless steel or other high-tech polymer material.

The one-piece, snap-on, twin-grooved, aft facing headstay luff system provides a extruded integral one-piece member, not only vertically length but also horizontally in cross section. The member wraps around between the aft luff and the forward luff forming a rounded forward aft portion, that rounded forward aft portion forming the forestay hole. The one-piece member wraps around the aft luff groove, the forward luff groove, passes by the forward luff groove by the width of the geometrical cross-section, and slightly offsets the aft luff groove with respect to the forward luff groove and forestay hole by the width of the wrap around member. The longitudinal side portion which touches the forward luff groove provides the strength and integrity to the extruded luff member during the high torque and high tensile forces exerted by the sails during sailing. The specific physical sizes are determined by the size of the boat, the length of the forestay, as well as the diameter of the forestay, and the square footage of the sail area.

Various modifications can be made to the present invention without departing from the apparent scope thereof. While the aft luff groove, the forward luff groove, and the forestay hole have been illustrated as being in substantially geometrical alignment with respect to each other, the aft luff groove and aft luff slot, as well as the forward luff groove and forward luff slot, can be positioned in any geometrical pattern with respect to each other as long as there in a one-piece, snap-on member which is continuously extruded. While the amount of molding material may change in the geometrical cross-section, as long as the material is a continuous one-piece cross-section horizontally, as well as vertically, and snaps around the stay back to a predetermined geometrical memory would be encompassed within the scope of the patent.

We claim:

1. An elongated support for simultaneously supporting a plurality of sailboat sails, on a sailboat stay wherein each sail has a forward edge luff comprising an elongated luff support member including:

first and second wall means formed to define a first elongated channel;

third wall means defining a second channel having a narrow slot opening, said third wall means being mounted to said first wall means and extending toward said second wall means;

fourth wall means defining a third channel positioned on an opposite side of said second channel from the first channel, said fourth wall means being mounted to said second wall means and having a narrow slot opening facing in a different angular direction from the narrow slot opening of said second channel with respect to a bisecting plane of the first channel, and said second and third channels together defining a stay retaining slot opening leading to said first channel, which is resiliently closed by the first and second wall means urging the third wall means forming the second channel toward the second wall means, said stay retaining slot being openable by moving the third wall means away from the second wall means against the resilient urging.

2. The luff member of claim 1 wherein said luff member is made of PVC.

3. The luff member of claim 1 wherein said luff member is made of Lexan.

4. The luff member of claim 1 wherein said luff member is a continuously one-piece extruded member.

5. The luff member of claim 1 wherein said channels are substantially aligned with respect to each other.

6. The luff member of claim 1 wherein said luff member includes an ultraviolet impervious chemical.

7. The luff member of claim 5 wherein said narrow slot openings are at an angle of approximately 20° with respect to each other measured with respect to a plane passing through the longitudinal centerlines of the respective second and third channels.

8. A sailboat luff system comprising:

a. A longitudinally continuous extruded one-piece luff member including a snap-on, one-piece, wrap-around luff member including a forward luff groove with a narrow slot, a rearward luff groove with a narrow slot, and a forestay channel formed in the continuous extruded member, said luff grooves and forestay channel being longitudinally coextensive;

b. feeder means adapted for securing around a lower end of said luff member, said feeder means including a separate passageway for each of the corresponding grooves in the luff member which are aligned with the luff member grooves and have lower guide surfaces tapered toward the separate passageways, said feeder means have slots aligning with the slots of the luff member;

c. A V-shaped member having spaced ears, a pair of rollers, one mounted on each of said ears for accepting a sail tape between the rollers; and d. means to support the V-shaped member below the feeder means for guiding a sail tape for selective feeding into each of the grooves in the feeder means and thus into the respective luff grooves of the luff member.

9. The system of claim 8 wherein said grooves and forestay channel are substantially aligned with respect to each other along a desired plane.

10. The system of claim 8 wherein said feeder is stainless steel.

11. System of claim 8 wherein said feeder passageways comprise aligned aft and forward grooves with connecting slots, and a vertical forestay slot for receiving a sailboat forestay.

12. The system of claim 11 wherein said passageways are of a downward increasing cross sectional size.

13. The sailboat luff system of claim 8 wherein said means to support the V-shaped member comprises a spacer mounted on a forestay holding the luff member, said V-shaped member being spaced farther from the forestay than the luff grooves in the luff member, to provide a lead in guide at a desirable angle with respect to the axis of the forestay.

14. A luff support member for a forestay of a sailboat comprising:

a. an aft luff groove including a rearward facing aft slot;

b. a forward luff groove including a second slot forwardly of the first slot, said second slot facing sidewardly, said forward luff groove being substantially aligned in front of said aft luff groove;

c. a forestay receiving channel substantially axially aligned with said first and second grooves;

d. said aft luff groove, said forward luff groove and said forestay receiving channel being formed of a continuous one-piece extruded member, said member having an integral wall wrapping around one side of said aft luff groove and having a first wall section extending forwardly for forming a rounded front portion defining a closed leading edge of said forestay channel, and having a second wall section extending in aft direction parallel to the first wall section and integrally wrapping around said forward luff groove, the extended member having predetermined resilient characteristics to permit the first and second wall sections to be separated to open the forestay receiving channel for installation about a forestay.

15. The luff member of claim 14 wherein said grooves are substantially in axial alignment with respect to each other.

16. The luff member of claim 14 wherein said forestay channel and forward luff groove are aligned along a bisecting plane of the forestay channel, and said aft luff groove is substantially offset by a dimension width of a back longitudinal member of said luff member.

17. The luff member according to claim 14 wherein said luff slots are at an angle of approximately 20° with respect to each other about the longitudinal centerline thereof.

18. The luff member of claim 14 wherein said luff member is made of PVC.

19. The luff member of claim 14 wherein said luff member is made of Lexan.

20. A support member for receiving a sailboat luff having an elongated bead at an outer leading edge, and supporting said luff and a sail connected to said luff to a sailboat stay, comprising:

first wall means defining a first encompassing channel having an open slot;

second wall means defining a second encompassing channel having a second open slot;

third wall means joining the first and second wall means and forming a third encompassing channel adapted to be supported by a stay of a sailboat, said first and second wall means being positioned on the respective outer edges of the third wall means on opposite sides of the third channel and positioned so that the first and second wall means together define a third slot opening to the third channel between the first and second channels, said channels being sequentially aligned along a central plane with respect to each other, said first and second channels and the first and second slots thereof being of size to permit a bead of a luff tape on a sail to be slid longitudinally along the channel with such sail passing through the respective slot, the first and second channels trailing the third slot when installed on a sailboat stay.

21. The support member of claim 20 wherein the first and second wall means are oriented so said first and second slots face at different angles with respect to a bisecting plane bisecting the third channel, said third slot being openable by separation of the first and second channels to permit the member to be mounted on a sailboat stay with the third channel being supported on the sailboat stay and the stay extending longitudinally along said third channel.

* * * * *